US008534884B2

(12) United States Patent
Lui

(10) Patent No.: US 8,534,884 B2
(45) Date of Patent: Sep. 17, 2013

(54) LIGHT EMITTING DIODE BULB

(75) Inventor: Min-Jet Lui, Chu-Nan (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 103 days.

(21) Appl. No.: 13/325,011

(22) Filed: Dec. 13, 2011

(65) Prior Publication Data

US 2013/0083547 A1 Apr. 4, 2013

(30) Foreign Application Priority Data

Sep. 27, 2011 (TW) ..... 100135147 A

(51) Int. Cl.
*F21V 19/00* (2006.01)
*F21V 21/00* (2006.01)
*F21V 29/00* (2006.01)

(52) U.S. Cl.
USPC ..... 362/427; 362/373; 362/294; 362/382; 362/429; 362/249.02

(58) Field of Classification Search
USPC ..... 362/427, 428, 249.1, 177, 269, 199, 362/429–430, 382, 249.01–249.02, 294, 362/373
See application file for complete search history.

(56) References Cited

U.S. PATENT DOCUMENTS

| | | | | |
|---|---|---|---|---|
| 8,113,698 | B2 * | 2/2012 | Wu et al. | 362/373 |
| 2011/0241529 | A1 * | 10/2011 | Matsui et al. | 313/318.01 |
| 2011/0286227 | A1 * | 11/2011 | Dellian et al. | 362/430 |
| 2013/0003372 | A1 * | 1/2013 | Dalsgaard | 362/249.1 |

FOREIGN PATENT DOCUMENTS

| | | | |
|---|---|---|---|
| CN | 202382054 U | * | 8/2012 |
| CN | 102748590 A | * | 10/2012 |
| CN | 102748600 A | * | 10/2012 |
| JP | 2011129357 A | * | 6/2011 |
| JP | 2012133919 A | * | 7/2012 |
| KR | 2011042720 A | * | 4/2011 |
| WO | WO 2011030567 A1 | * | 3/2011 |

* cited by examiner

*Primary Examiner* — Mariceli Santiago
(74) *Attorney, Agent, or Firm* — Altis Law Group, Inc.

(57) ABSTRACT

A light emitting diode (LED) bulb includes a lamp seat for connecting the LED bulb to an external power source, a rotatable member rotatably connected to the lamp seat, two holders fixed to the rotatable member and a lamp head pivotally connecting with the holders. The rotatable member is rotatable around a first axis. The lamp head is rotatable around a second axis. The second axis is unparallel to the first axis. Thus, an illumination angle of the lamp head can be adjusted with respect to the lamp seat along two planes. An LED module is attached to the lamp head.

14 Claims, 4 Drawing Sheets

LIGHT EMITTING DIODE BULB

BACKGROUND

1. Technical Field

The disclosure relates to a light emitting diode (LED) bulb, and particularly to an LED bulb providing an adjustable illumination area.

2. Description of the Related Art

A light bulb has a variety of applications and is suitable for use as a ceiling light or a wall light, etc. The light bulb is generally mounted on a lamp socket. The light bulb has a fixed illumination angle and cannot be adjusted whereby the application of the light bulb is limited.

What is needed, therefore, is a light bulb, particularly, an LED bulb having an adjustable illumination angle.

BRIEF DESCRIPTION OF THE DRAWINGS

Many aspects of the disclosure can be better understood with reference to the following drawing. The components in the drawing are not necessarily drawn to scale, the emphasis instead being placed upon clearly illustrating the principles of the present light emitting diode package for microminiaturization. Moreover, in the drawing, like reference numerals designate corresponding parts throughout the whole view.

DETAILED DESCRIPTION

Figure 1:
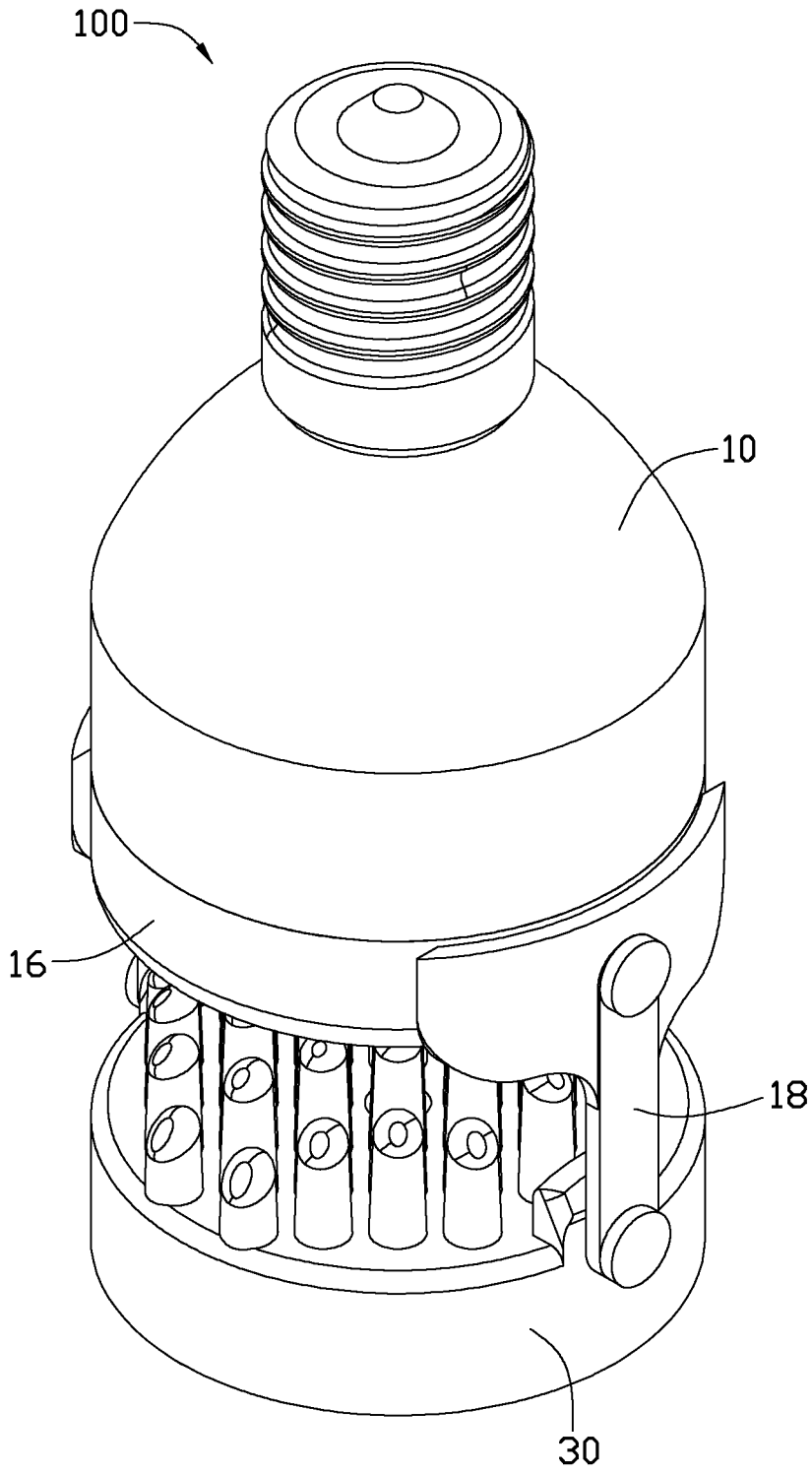
FIG. 1 is a schematic, isometric, assembled view of an LED bulb in accordance with an exemplary embodiment.

Reference will now be made to the drawing figures to describe the present electronic device in detail.

Referring to FIG. 1, an LED bulb 100 according to the present disclose includes a lamp seat 10, a rotatable member 16 rotatably connecting to the lamp seat 10, two holders 18 fixedly mounted on the rotatable member 16 and a lamp head 30 pivotably connecting with the holders 18.

Figure 2:
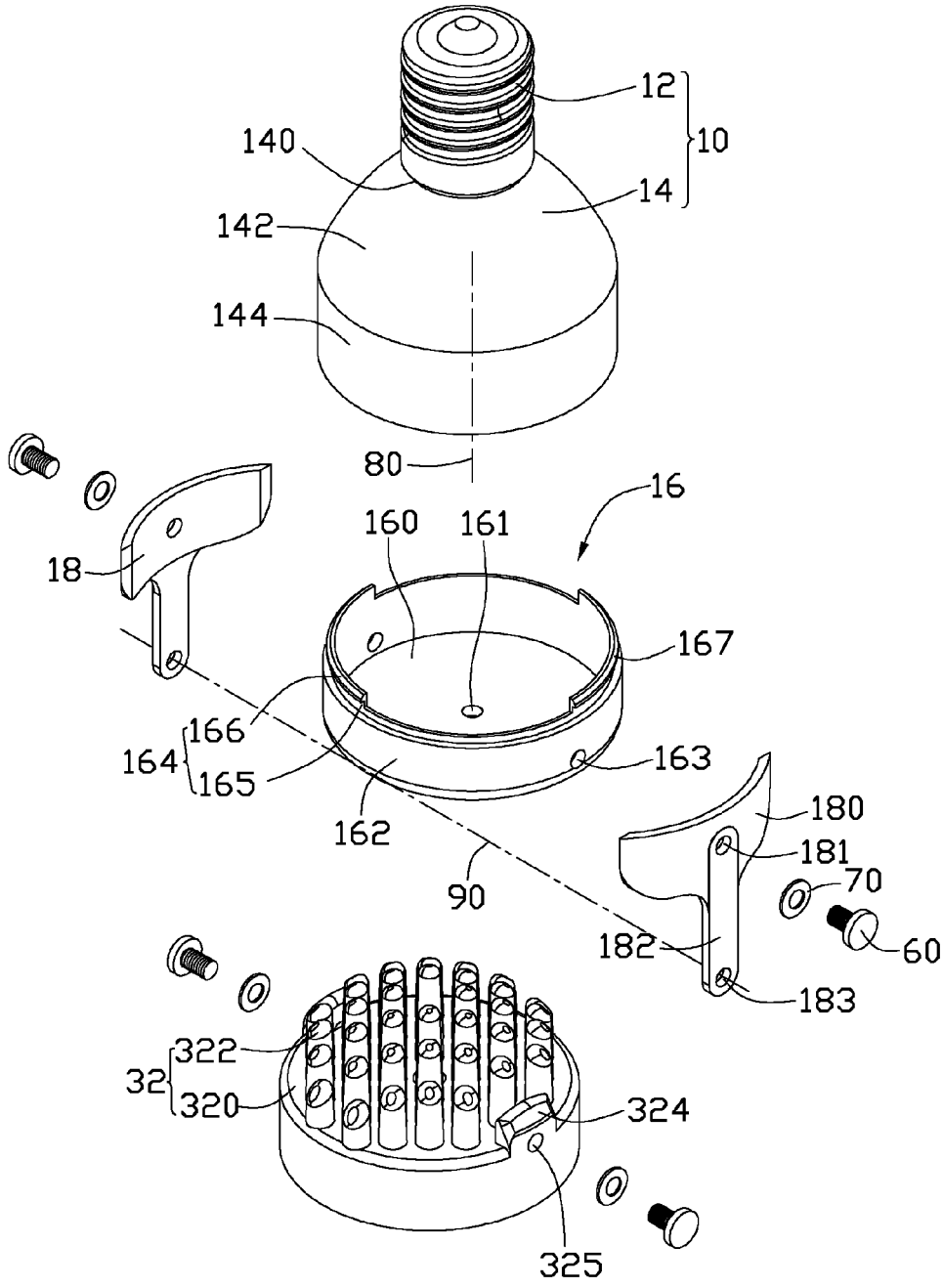
FIG. 2 is an exploded view of the LED bulb of FIG. 1.
Figure 3:
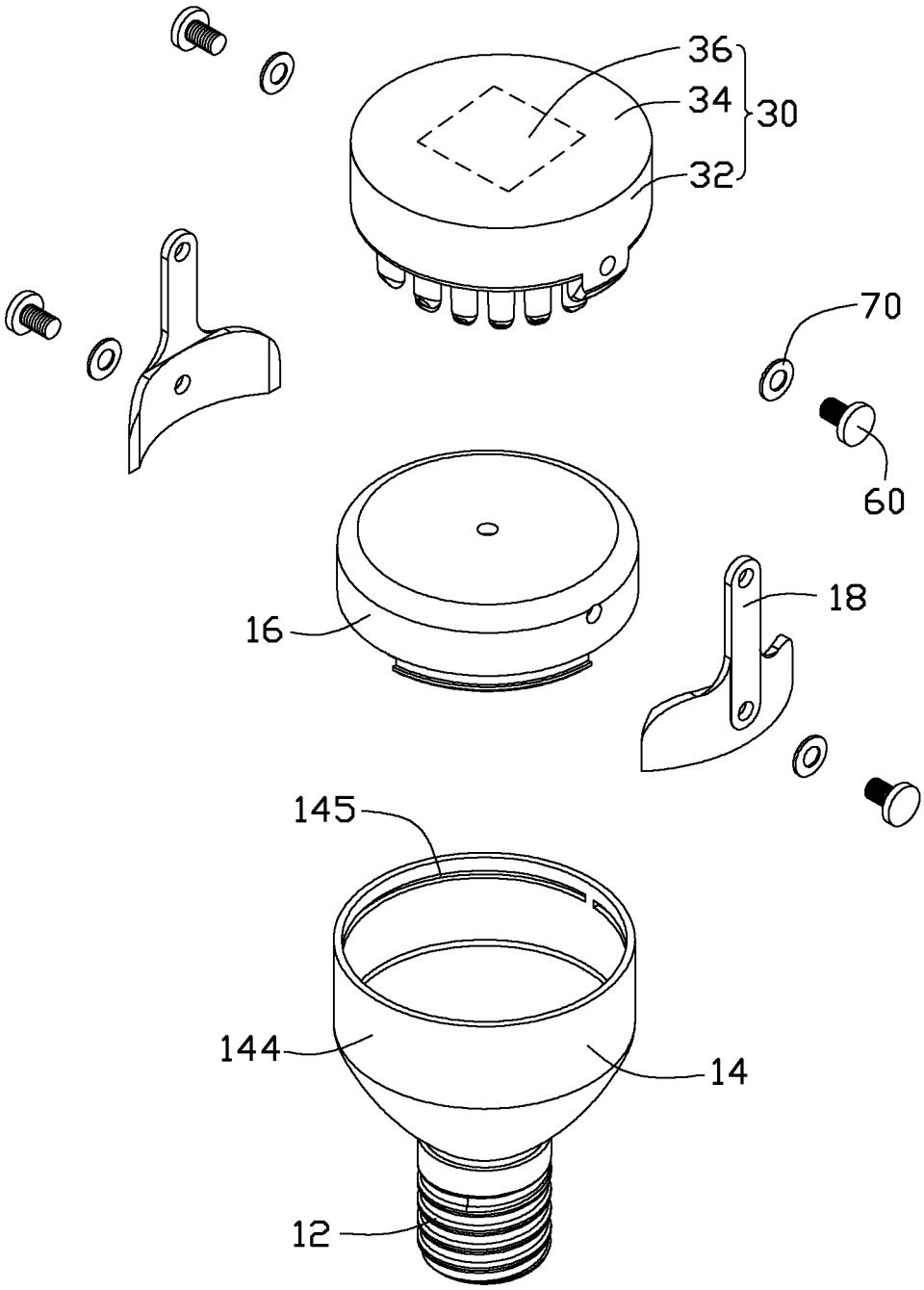
FIG. 3 is an inverted view of the LED bulb of FIG. 2.
Figure 4:
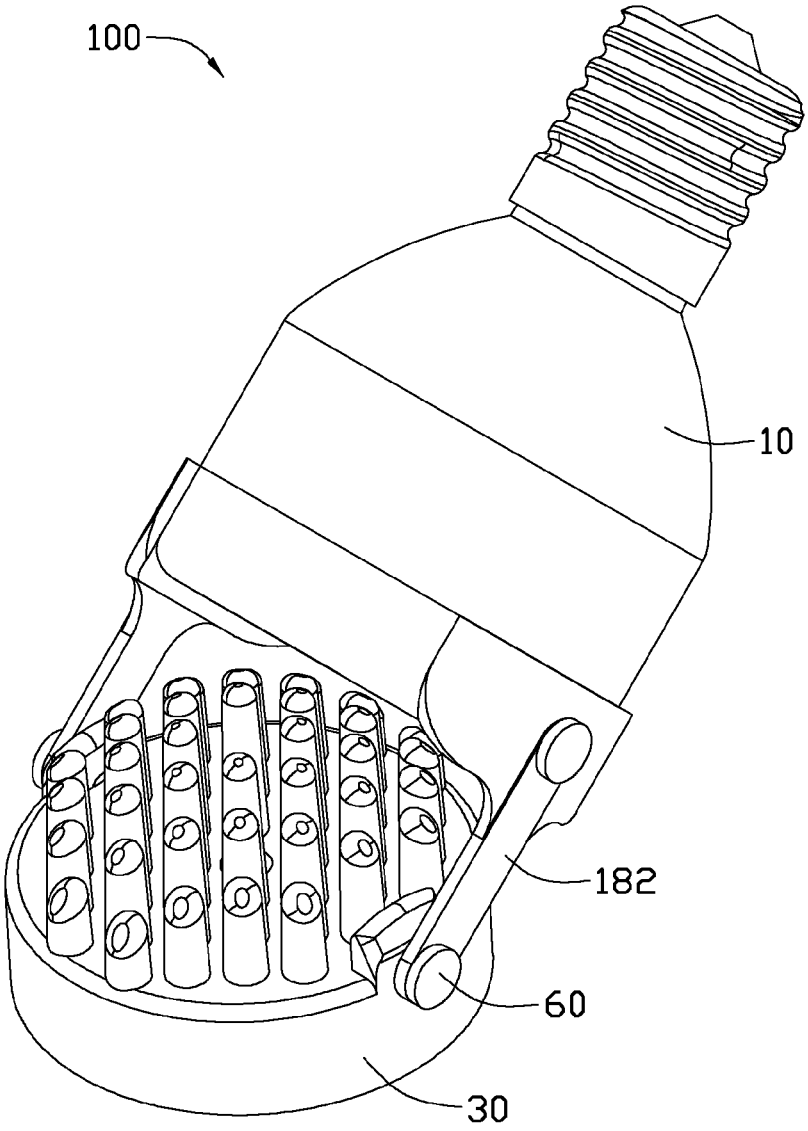
FIG. 4 is similar to FIG. 1, but showing the LED bulb in another position.

Referring to FIGS. 2 and 3, the lamp seat 10 includes an electrical connector 12 and a casing 14 extending from the electrical connector 12. The electrical connector 12 is used for connecting a socket of an outer power supply for providing electricity to the LED bulb 100. The electrical connector 12 can be a standard connector, for example, an Edison holder such as E27, etc., for facilitating the connection of the LED bulb 100 with an existed socket.

The casing 14 is made of electrically insulating material. The casing 14 has a funneled shape and includes a small end 140 connecting with the electrical connector 12, a large end 144, and a collar 142 interconnecting the small end 140 and the large end 144. The conical collar 142 receives a driving module (not shown) therein to connect the electrical connector 12 with the lamp head 30. A diameter of the conical collar 142 gradually enlarges from the small end 140 to the large end 144. The large end 144 has an annular shape. The larger end 144 defines two arced recesses 145 in an inner wall thereof. The arced recesses 145 are in a same circle and face each other.

The rotatable member 16 includes a circular plate 160, an annular sidewall 162 and two locking portions 164. The plate 160 defines a central hole 161 for extension of wires (not shown) of the LED bulb 100, wherein the wires are used for electrically connecting the connector 12 and the lamp head 30. The sidewall 162 extends up from a periphery of the plate 160, and defines two opposite securing holes 163 therein. The locking portions 164 extend upwards from a top edge of the sidewall 162 and separate from each other. Each of the locking portions 164 includes an arced elastic arm 165 extending upwards from the sidewall 162 and an arced engaging portion 166 protruding outwards from a top edge of the elastic arm 165. Each of the engaging portions 166 has an engaging surface 167 gradually slanting downwards and outwards, as viewed from FIG. 2. In assembly of the casing 14 and the rotatable member 16, the locking portions 164 are elastically inserted into the larger end 144 of the casing 14 with the engaging portions 166 received in the recesses 145; thus, the rotatable member 16 can be rotated around a first axis 80 of the large end 144 of the casing 14 clockwise or anticlockwise. The first axis 80 extends through a center of the casing 14.

In this embodiment, an arced length of each engaging portion 166 is less than an arced length of each circumferential recess 145. The arced length of each engaging portion 166 is slightly less than one quarter of a circumference of the large end 144 of the casing 14. The circumferential recesses 145 are disconnected to each other. The arced length of each circumferential recess 145 is slightly less than a half of the circumference of the large end 144 of the casing 14. Thereby, the rotatable member 16 can rotate from 0 degrees to about 90 degrees relative to the casing 14. Alternatively, in another embodiment, an amount of the locking portions 164 can be one or more than two, and the circumferential recesses 145 can communicate with each other to form a continuously circular recess, whereby the rotatable member 16 can rotate relative to the casing 14 around the first axis 80 from 0 degrees to 360 degrees in a horizontal plane.

The holders 18 are mounted at two opposite sides of the rotatable member 16. Each of the holders 18 includes a mounting portion 180 and a support arm 182 extending downwards from the mounting portion 180. Each of the mounting portions 180 is an arced sheet corresponding to an outer surface of the rotatable member 16. Each of the mounting portions 180 defines a through hole 181 corresponding the securing hole 163. The holders 18 are mounted on the rotatable member 16 by fasteners 60 with washers 70, wherein the fasteners 60 extend through the washers 70 and the through holes 181 to engage in the securing holes 163. Each of the support arms 182 defines a pivot hole 183 at a bottom end thereof. Alternatively, the holder members 18 can be integrally formed with the rotatable member 16 as one piece.

The lamp head 30 includes a heat sink 32, a light module 36 mounted at a bottom of the heat sink 32 and an envelope 34 engaging on the heat sink 32 and covering the light module 36. The heat sink 32 includes a base 320 and two ears 324 extending from two sides of the base 320. A plurality of heat-dissipating rods 322 are formed on a top face of the base 320 as viewed from FIG. 2. The ears 324 define mounting holes 325 in alignment with the pivot holes 183 of the support arms 182. The light module 36 is an LED module including a plurality of LEDs. The lamp head 30 is pivotably engaged with the holders 18 by fasteners 60 extending through the pivot holes 183 and engaging in the mounting holes 325. Thereby, the lamp head 30 can be turned around the fasteners 60 in 360 degrees around a second axis 90 of the holders 18. The second axis 90 is perpendicular to the first axis 80.

In use, the lamp head 30 is rotatable relative to the lamp seat 10 via rotation of the rotatable member 16 or the lamp head 30. According to different requirements of illumination area, the lamp head 30 can be adjusted to a suitable aspect relative to the lamp seat 10 and fixed in position by tightening the fasteners 60 in the mounting holes 325.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A light emitting diode (LED) bulb, comprising:

a lamp seat adapted for connecting the LED bulb to an external power source;

a rotatable member rotatably connected to the lamp seat, two holders extending out from the rotatable member, the rotatable member being rotatable around a first axis extending through a center of the lamp seat; and a lamp head pivotally connecting with the holders, the lamp head being rotatable around a second axis, the second axis being unparallel to the first axis, the lamp head having an LED module thereon for emitting light;

wherein the lamp seat comprises a small end connecting with an electrical connector and an annular large end rotatably engaged with the rotatable member, the first axis is a central axis of the annular large end; and wherein the rotatable member comprises an annular sidewall and two locking portions extending from the annular sidewall and rotatably engaging in the large end of the casing of the lamp seat, the holders being mounted on the annular sidewall.

2. The LED bulb of claim 1, wherein the second axis is perpendicular to the first axis.

3. The LED bulb of claim 1, wherein the lamp head is pivotally engaging the holders by fasteners, and the second axis is defined through the fasteners.

4. The LED bulb of claim 1, wherein the lamp seat defines a circumferential recess in an inner wall of the large end of the casing of the lamp seat to elastically receive the locking portions of the rotatable member.

5. The LED bulb of claim 1, wherein the lamp seat defines two arced recesses in an inner wall of the large end of the casing of the lamp seat to elastically receive the locking portions of the rotatable member.

6. The LED bulb of claim 5, wherein the arced recesses are disconnected from each other, and the locking portions separate from each other, and the locking portions are received in the recesses, respectively.

7. The LED bulb of claim 5, wherein an arced length of each engaging portion is slightly less than one quarter of a circumference of the large end of the casing, and an arced length of each circumferential recess is slightly less than a half of the circumference of the large end of the casing.

8. The LED bulb of claim 5, wherein each of the locking portions includes an arced elastic arm extending from the sidewall and an arced engaging portion protruding outwards from the elastic arm.

9. The LED bulb of claim 8, wherein each of the engaging portions has an engaging surface gradually slanting outwards toward the lamp head.

10. The LED bulb of claim 1, wherein the lamp head comprises a heat sink and an envelope, the LED module being attached on the heat sink, the envelope covering the LED module and the heat sink pivotably engaged with the holders.

11. A light emitting diode (LED) bulb, comprising:

a lamp seat adapted for connecting the LED bulb to an external power source;

a rotatable member rotatably connected to the lamp seat, two holders extending out from the rotatable member, the rotatable member being rotatable relative to the lamp seat;

a lamp head pivotally connecting the holders by fasteners extending through the holders and in the lamp head, the lamp head being rotatable around the fasteners, wherein the lamp head is movable relative to the lamp seat about two planes to adjust an illumination angle of the lamp head with respect to the lamp seat; and an LED module mounted on the lamp head;

wherein the rotatable member comprises an annular sidewall and two locking portions extending from the annular sidewall and rotatably engaging in the lamp seat, the holders being fixedly mounted on the annular sidewall.

12. The LED bulb of claim 11, wherein the lamp seat defines two arced recesses in an inner wall of the lamp seat to elastically receive the locking portions of the rotatable member.

13. The LED bulb of claim 12, wherein an arced length of each engaging portion is slightly less than one quarter of a circumference of lamp seat, and an arced length of each circumferential recess is slightly than a half of the circumference of the lamp seat.

14. A light emitting diode (LED) bulb, comprising:

a lamp seat adapted for connecting the LED bulb to an external power source;

a rotatable member rotatably connected to the lamp seat, two holders extending out from the rotatable member, the rotatable member being rotatable around a first axis extending through a center of the lamp seat; and a lamp head pivotally connecting with the holders, the lamp head being rotatable around a second axis, the second axis being unparallel to the first axis, the lamp head having an LED module thereon for emitting light;

wherein the lamp head comprises a heat sink and an envelope, the LED module being attached on the heat sink, the envelope covering the LED module and the heat sink pivotably engaged with the holders.

* * * * *